US009244432B2

(12) United States Patent
Lagorgette et al.

(10) Patent No.: US 9,244,432 B2
(45) Date of Patent: Jan. 26, 2016

(54) SHOCKPROOF CENTRE WHEEL

(71) Applicant: ETA SA MANUFACTURE HORLOGÈRE SUISSE, Grenchen (CH)

(72) Inventors: Pascal Lagorgette, Bienne (FR); Raphael Balmer, Courrendlin (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 0 days.

(21) Appl. No.: 14/175,506

(22) Filed: Feb. 7, 2014

(65) Prior Publication Data

US 2014/0226447 A1 Aug. 14, 2014

(30) Foreign Application Priority Data

Feb. 12, 2013 (EP) ..... 13154875

(51) Int. Cl.
*G04B 17/20* (2006.01)
*G04B 13/02* (2006.01)
*G04B 35/00* (2006.01)

(52) U.S. Cl.
CPC ..... *G04B 17/20* (2013.01); *G04B 13/021* (2013.01); *G04B 35/00* (2013.01)

(58) Field of Classification Search
CPC .... G04B 17/20; G04B 13/021; G04B 13/025; G04B 35/00
USPC ..... 368/80, 127–132, 228, 322–326; 384/125, 215, 244
See application file for complete search history.

(56) References Cited

U.S. PATENT DOCUMENTS

| | | | | |
|---|---|---|---|---|
| 2,239,682 | A * | 4/1941 | Fritz | 368/326 |
| 2,958,998 | A * | 11/1960 | Matthey et al. | 368/326 |
| 2,973,618 | A * | 3/1961 | Morf | 368/326 |
| 6,441,516 | B1 * | 8/2002 | Kaelin et al. | 310/36 |
| 7,438,465 | B2 * | 10/2008 | Bitterli et al. | 368/322 |
| 7,572,050 | B2 * | 8/2009 | Bitterli et al. | 368/324 |
| 2008/0112276 | A1 * | 5/2008 | Bitterli et al. | 368/322 |
| 2009/0154301 | A1 * | 6/2009 | Sakamaki et al. | 368/220 |

FOREIGN PATENT DOCUMENTS

| | | |
|---|---|---|
| CH | 67295 A | 12/1914 |
| EP | 1 705 533 A1 | 9/2006 |
| EP | 1 921 516 A1 | 5/2008 |

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

Shockproof timepiece wheel for driving a component having unbalance relative to a pivot axis of this wheel, The wheel includes, on the one hand, an arbour for pivotally guiding the wheel about this pivot axis, and on the other hand, a drive device arranged or assembled on a flange of this wheel, the wheel including at least one flexible element between this arbour and the flange. The flange includes a cylindrical shoulder, which cooperates in abutment for centring purposes with a complementary cylindrical shoulder provided in the arbour to ensure the perfect concentricity of the drive device with the arbour.

27 Claims, 12 Drawing Sheets

SHOCKPROOF CENTRE WHEEL

This application claims priority from European patent application No. 13154875.2 filed Feb. 12, 2013, the entire disclosure of which hereby incorporated by reference.

FIELD OF THE INVENTION

The invention concerns a shockproof timepiece wheel for driving a component having unbalance relative to a pivot axis of said wheel, said wheel includes, on the one hand an arbour for pivotally guiding the wheel about said pivot axis, and on the other hand, a drive means arranged or assembled on a flange of said wheel, said wheel including at least one flexible element between said arbour and said flange.

The invention further concerns a timepiece movement including a wheel of this type carrying one said component having unbalance relative to a pivot axis of said wheel.

The invention also concerns a watch including at least one timepiece movement of this type.

The invention concerns the field of protection of watches against the effects of shocks, in particular when the watches include moving components with significant unbalance liable to damage a more fragile element in the kinematic chain in the event of a shock.

BACKGROUND OF THE INVENTION

The use of technologies permitting the use of hands with greater unbalance entails new problems:

the hands sliding on the tubes;

breakage of gear trains and/or rotors in electrical versions, in the event of a 5000 g shock.

This latter point is by far the most critical. In certain existing calibres, this type of breakage may occur in the event of a 5000 g shock, such as an accidental fall from the user's height.

Breakage means that the watch no longer functions, which strongly impacts the quality perceived by the user.

It is an object of the invention to prevent the gear trains and/or rotor from breaking by absorbing the energy from a shock, without affecting the design of the hands. Indeed, if a counterweight can be added to the hands to reduce their unbalance and thereby reduce the torque exerted during a large shock, this type of solution impairs the appearance of the hands desired by the manufacturers.

The energy from a shock must be absorbed to permit the use of hands with significant unbalance, which are increasingly common with the current trend of increasing the diameter of watches.

EP Patent No 1921516 in the name of the Swiss Watch Manufacturer ETA SA discloses a fastening for a silicon assembly element for use as a rotating element, in particular a hand or a toothed wheel. This assembly element includes two series of resilient structures etched into different layers of the plate in which the element is fabricated, to radially grip an arbour.

EP Patent No 1705533 in the name of PATEK PHILIPPE SA discloses an assembly of a silicon part on an arbour including a shoulder adjoining an axial stop member. The part includes a passage cooperating with the shoulder. The device further includes a washer with a hole fixed to the arbour so that the part is located between the stop member and the washer. The only possibility of protection against external stresses is provided by the elasticity of the silicon where the arbour is clamped.

CH Patent No 67295 in the name of BBC BROWN BOVERI & CIE discloses a wheel for heavy machinery including a toothed crown centred on a hub, with, just under the surface, a vibration or shock absorber device in the form of a tangentially mounted helical shock absorber spring, which is necessarily very bulky and unsuitable for horological applications.

SUMMARY OF THE INVENTION

The basic principal of the invention is to absorb the shock by permitting the elastic torsion of one component of the gear train and, more particularly, of the centre wheel. This torsion is achieved by a sliding motion between a centre arbour and a flange. An elastic element permits absorption of the shock. The arbour/flange sliding motion permits some energy dissipation by friction. The elastic element enables the amplitude and duration of the shock to be modified (lower amplitude and longer duration).

The invention therefore concerns a shockproof timepiece wheel for driving a component having unbalance relative to a pivot axis of said wheel, said wheel includes, on the one hand an arbour for pivotally guiding the wheel about said pivot axis, and on the other hand, a drive means arranged or assembled on a flange of said wheel, said wheel including at least one flexible element between said arbour and said flange, characterized in that said flange includes a cylindrical shoulder cooperating in abutment for centring purposes with a complementary cylindrical shoulder comprised in said arbour to ensure the perfect concentricity of said drive means with said arbour, and characterized in that said flexible element is mounted, either confined between said flange and a locking washer held on said arbour, or snapped onto said flange and/or said arbour.

According to a feature of the invention, said flexible element is an interchangeable element distinct from said arbour and from said flange and whose resilience is selected according to the maximum allowable value of said unbalance.

The invention further concerns a timepiece movement including a wheel of this type carrying one said component exhibiting unbalance relative to a pivot axis of said wheel, characterized in that said component is a hand, or an oscillating weight, or a strike hammer or a lever.

The invention also concerns a watch including at least one timepiece movement of this type.

BRIEF DESCRIPTION OF THE DRAWINGS

Other features and advantages of the invention will appear upon reading the following detailed description, with reference to the annexed drawings, in which:

FIGS. 30 and 31 show the arbour with a front groove for receiving the spring shown in FIG. 32, the flange being shown in perspective in FIG. 33, and the assembly in a top view in FIG. 34.

DETAILED DESCRIPTION OF PREFERRED EMBODIMENTS

Figure 1:
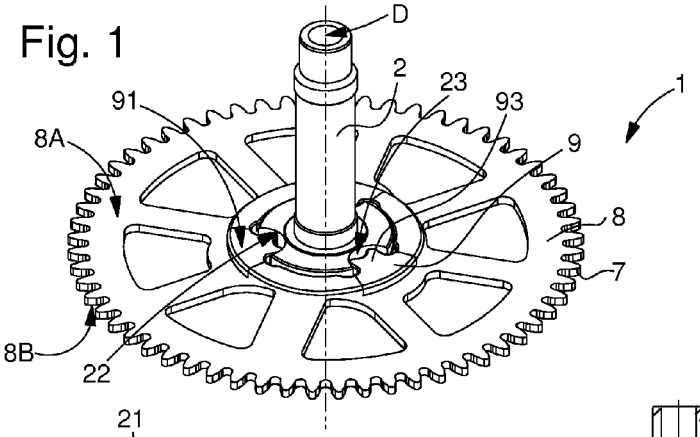
FIG. 1 shows a schematic, perspective view of a shockproof timepiece wheel in a first embodiment of the invention wherein said wheel, illustrated here in the form of a minute wheel, includes a toothed flange centred on an arbour, and fixed to said arbour by a bayonet mechanism, said flange being pivotally connected to said arbour by an elastomer or similar flexible element which can deform in the event of a shock, said flexible element is pressed onto a top surface of the flange, and snapped underneath a bottom surface of said flange.
Figure 2:
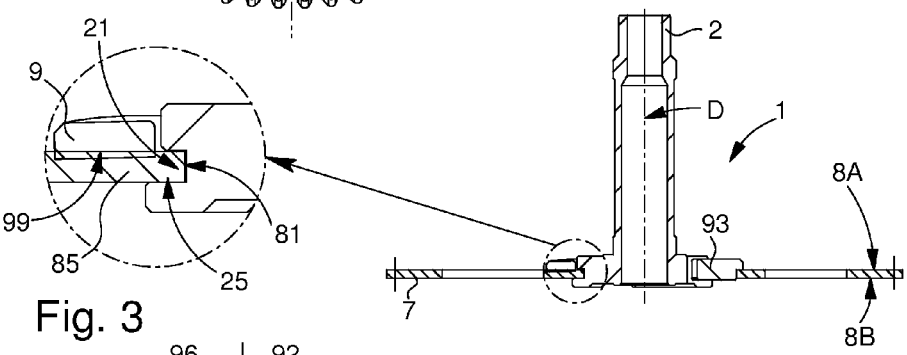
FIG. 2 shows a schematic cross-section of the wheel of FIG. 1 through its pivot axis.

The invention proposes to improve the protection of watches against the effects of shocks. The effect of a large shock on a moving component with significant unbalance risks damaging the most fragile elements in the kinematic chain.

The invention therefore concerns a shockproof timepiece wheel 1 for driving a component 4 having unbalance relative to a pivot axis D of wheel 1.

Wheel 1 includes, on the one hand an arbour 2 (which may be tubular or solid) for pivotally guiding the wheel about pivot axis D, and on the other hand, a drive means 7 arranged to assembled on a flange 8 of wheel 1. This drive means 7 may be a toothed sector, a track for a belt or chain or similar, or other element.

Wheel 1 includes at least one flexible element 9 between arbour 2 and flange 8 for absorbing the shock impact and damping the effect on the other components of watch movement 100, in which wheel 1 of the invention is incorporated.

According to the invention, flange 8 includes a cylindrical shoulder 81 cooperating in abutment, to achieve centring, with a complementary cylindrical shoulder 21 comprised in arbour 2 to ensure the perfect concentricity of drive means 7 with arbour 2. Therefore perfect geometry and precise motion transmission are always ensured. This arrangement ensures that there is no out-of-roundness, or any vibration interference as a result of extremely reduced play.

The Figures illustrate several, non-limiting embodiments of the invention.

Of the embodiments illustrated, the first three embodiments, illustrated in FIGS. 1 to 34 and 41 to 47, concern an advantageous variant of the invention, wherein flexible element 9, consisting of one or more components, is an interchangeable element distinct from arbour 2 and from flange 8. The resilience of this flexible element is selected according to the maximum allowable value of unbalance.

Thus it is possible to devise, for the same arbour 2—flange 8 pair, which determines the geometric interfaces with the rest of the movement, a series of flexible elements 9 having a similar geometry but different damping capacities, to adapt shockproof wheel 1 as well as possible to the context of use, and in particular to unbalance value, and also to the anticipated shock level, which depends on the use or destination of the watch, for example for users working in a necessarily vibrating environment, such as public works, or for users in a sporting, military or similar environment. As will be seen below, the assembly of wheel 1 is devised to be very simple, and it is therefore possible to tailor a watch to its conditions of use by selecting the appropriate flexible element 9.

According to the invention, flexible element 9 is mounted either confined between flange 8 and a locking washer 20 held on arbour 2, or snapped onto flange 8 and/or arbour 2.

Various non-limiting assembly versions are presented here. In particular, flexible element 9 may be mounted:

either confined between flange 8 and a locking washer 20 held on arbour 2, particularly driven or crimped onto arbour 2, or snapped on both sides of an area 10 of assembly of cylindrical shoulder 81 to complementary cylindrical shoulder 21, or snapped on in an assembly area 10 of cylindrical shoulder 81 and of complementary cylindrical shoulder 21.

In the first and second embodiment, flexible elements 9 are substantially flat circular gaskets, and are wedged between flange 8 and arbour 2. Flange 8 pivots on arbour 2. A washer resting on and riveted to arbour 2 forms an axial stop member for flange 8. The gaskets transmit the torque between flange 8 and arbour 2. In the event of a shock, the gaskets are deformed and thus absorb part of the energy from the shock. When the shock has finished, flange 8 returns to its initial position relative to arbour 2.

In the particular case of the application of the invention to a centre wheel 1 carrying a hand 5, the shock is absorbed directly in centre wheel 1. That is to say, the energy from the shock, exerted by the hand unbalance is absorbed as soon as possible into the torque transmission chain.

This prevents the breakage of any gear trains and rotors made of plastic material and having small pivots, which may be contained in a movement 100. The advantages of these plastic components are lower cost, pre-lubrication and a low level of friction on the pivots. The fact of being able to retain these components in a movement avoids the use of metal components, synonymous with an increase in costs and feasibility problems (particularly for the rotor of an electric or quartz movement). Shock absorption also prevents the hands from sliding on their arbour tube 2.

In the first embodiment illustrated in FIGS. 1 to 15, shockproof wheel 1, illustrated in the form of a minute wheel, includes a toothed flange 8 with a toothing 7 centred on an arbour 2, and secured to arbour 2 by a bayonet mechanism. This flange 8 is pivotally connected to arbour 2 by an elastomer or similar flexible element 9 that can deform in the event of a shock, said flexible element 9 is pressed onto a top surface 8A of flange 8, and snapped underneath a bottom surface 8B of flange 8.

This elastomer preferably has a hardness of between 50 and 70 Shore A, good results are obtained with a Shore hardness close to 65 Shore A. An "NBR", or butadiene-acrylonitrile type copolymer is particularly suitable. Other elastomers having a similar hardness may also be suitable. Naturally, the choice of elastomer depends on the position of the wheel within the gear train, the level of unbalance of the wheel set(s) with which the wheel meshes and on the shock level to be absorbed. It is clear that, although the invention is very advantageous in a centre wheel carrying the hand and thus significant unbalance, it can be used for an intermediate wheel which does not necessarily carry the unbalance.

Figure 8:
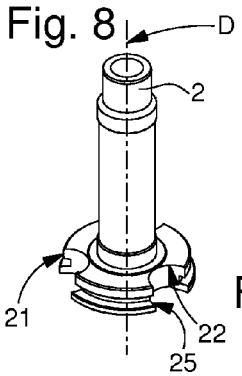
FIG. 8 shows a schematic, perspective view of the arbour of FIG. 1 including, contiguous with a cylindrical shoulder arranged to centre the flange, a radial groove arranged to axially immobilise the flange.

FIG. 8 shows, on arbour 2, contiguous with a cylindrical shoulder 21 arranged to centre flange 8, a radial groove 25 arranged to axially immobilise flange 8.

In this embodiment, flexible element 9 includes bosses 93 which are arranged, during normal operation, to transmit a drive torque between arbour 2 and flange 8 and, in the event of any shock, to absorb the torsion between arbour 2 and flange 8, to dissipate part of the energy from the shock by friction, to modify the effect on drive means 7 of the amplitude and duration of the shock, by reducing the amplitude and increasing the duration thereof, and to form an elastic return means returning flange 8 into a realignment position relative to arbour 2 after the shock.

These bosses 93 are preferably connected to each other by a ring 92 of flexible element 9, said ring 92 is arranged to abut on at least one lateral surface 8A of flange 8.

Preferably, ring 92 is located in a plane distinct from a plane in which bosses 93 extend, said bosses are intended to come within the thickness of flange 8, and have a similar thickness to that of flange 8.

Preferably, these bosses 93 are identical to each other and arranged regularly around an axial direction DA about which flexible element 9 extends.

Flange 8 includes housings 82 for receiving and centring bosses 93 of flexible element 9.

Arbour 2 also includes complementary housings 22 for receiving and centring bosses 93.

Arbour 2 and flange 8 are arranged so that, in at least one angular position of one relative to the other when said arbour and flange are assembled to cylindrical shoulder 81, cooperating in abutment for centring purposes with complementary cylindrical shoulder 21, housings 82 and complementary housings 22, in pairs, form slots 23 for receiving bosses 93 in a comprehensive and complementary manner when flexible element 9 is pressed onto flange 8.

Flange 8 includes a housing 81 for receiving arbour 2.

Advantageously, arbour 2 includes a groove 25 arranged to receive, in a first relative angular position, a rib 85 of flange 8, when arbour 2 and flange 8 are assembled to cylindrical shoulder 81 in abutment for centring purposes with complementary cylindrical shoulder 21, and when flange 8 is in an end stop position, in abutment, via a lateral surface 8A of flange 8, against a shoulder surface 27 of arbour 2. Groove 25 allows arbour 2 to pivot in the manner of a bayonet relative to flange 8 in at least a second relative angular position, in which housings 82 and complementary housings 22 are aligned and, in pairs, form slots 23 for receiving bosses 93 in a comprehensive and complementary manner when flexible element 9 is pressed onto flange 8, bosses 93 then angularly indexing flange 8 relative to arbour 2.

Figure 9:
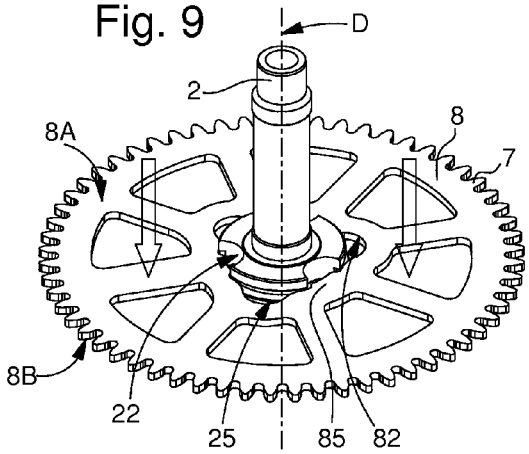
FIG. 9 shows a schematic, perspective view of the flange of FIG. 1 being fitted, in a first relative angular position of insertion onto the arbour in an end stop position.
Figure 10:
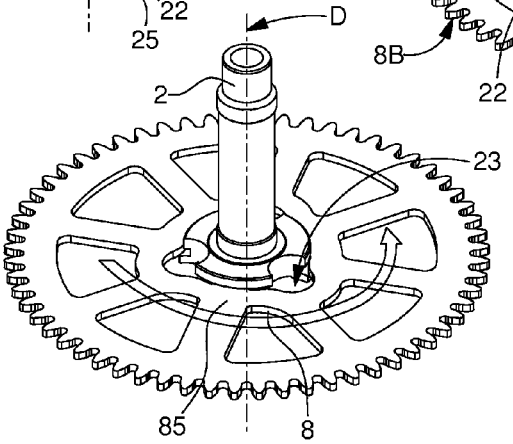
FIG. 10 shows the flange and arbour cooperating in a second angular position, after bayonet-type rotation and locking, said second angular position corresponding to the matching of receiving housings of the flange with complementary receiving housings comprised in the arbour, to form together slots for the fitting in position of bosses comprised in the flexible element.

FIG. 9 thus illustrates flange 8 being fitted onto arbour 2 in a first relative angular position of insertion, in an end stop position. FIG. 10 shows flange 8 and arbour 2 cooperating in a second angular position, after bayonet-type rotation and locking, said second angular position corresponding to the matching of receiving housings 82 of flange 8 with complementary receiving housings 22 of arbour 2, to form together slots 23 for the fitting in position of bosses 93 comprised in flexible element 9.

Figure 11:
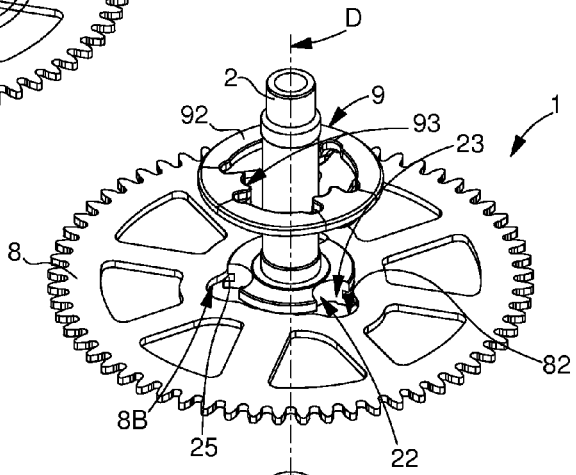
FIG. 11 shows a schematic, perspective view of the flexible element being placed in position, bearing on a top surface of the flange, and the cooperation of its bosses with the positioning slots.

FIG. 11 shows flexible element 9 being placed in position in abutment on a top surface 8A of flange 8, and the cooperation of its bosses 93 with positioning slots 23.

Figure 3:
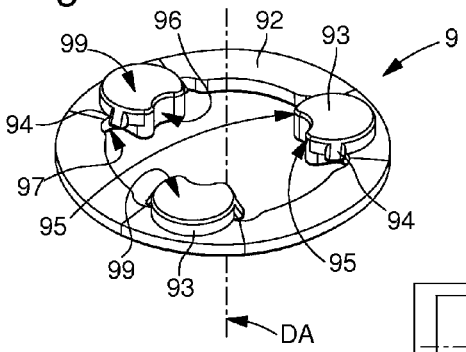
FIG. 3 shows a schematic, perspective view of the flexible element of FIG. 1.
Figure 4:
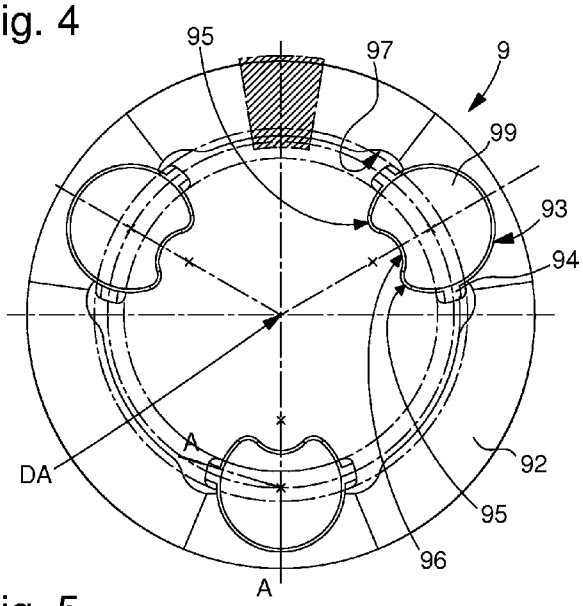
FIG. 4 shows a schematic, top, plan view of the same flexible element.
Figure 6:
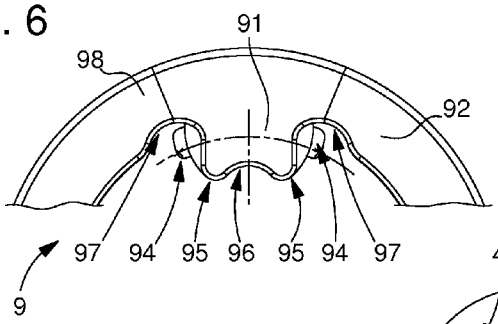
FIG. 6 a partial bottom view.
Figure 40:
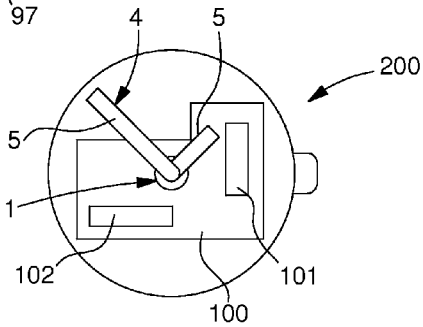
FIG. 40 shows a schematic view of a watch including a movement of this type.

In this embodiment, flexible element 9 includes snap-on lugs 94 (as shown in FIGS. 3, 4 and 6 but not shown in the other Figures) and is shown snapped on both sides of the assembly area 10 of cylindrical shoulder 81 and of complementary cylindrical shoulder 21.

Figure 7:
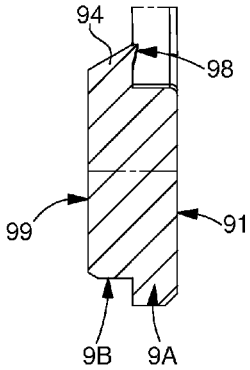
FIG. 7 a partial view along the cross-section AA of FIG. 4.
Figure 5:
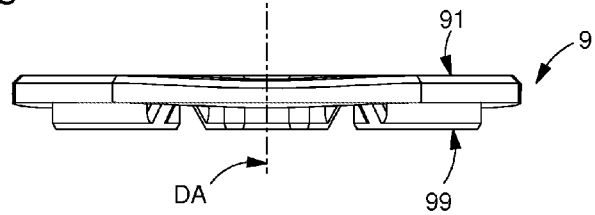
FIG. 5 shows a side view.
Figure 12:
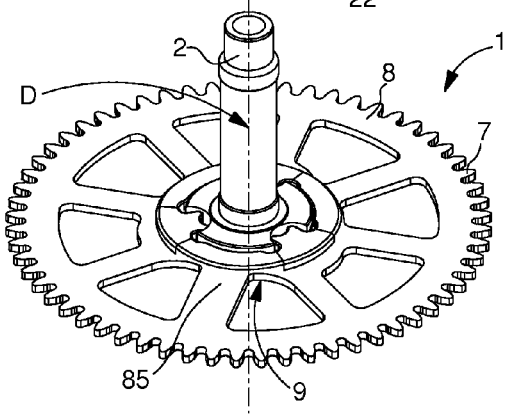
FIG. 12 shows the position achieved after snap-on lugs comprised in the flexible element, shown in FIGS. 4, 6 and 7, are snapped on around the flange bearing on a lower surface of the flange.

FIG. 12 shows the position attained once snap-on lugs 94 comprised in the flexible element have been snapped on, visible in FIGS. 4, 6 and 7, around the flange supported via the end 98 thereof on a bottom surface 8B of flange 8.

Figure 13:
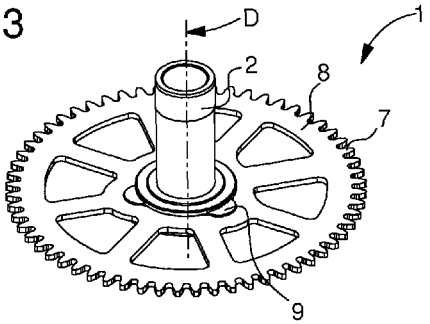
FIGS. 13 to 15 illustrate a similar assembly of an hour wheel, the assembly being achieved in the same manner but with arbour 2 turned the other way up.
Figure 14:
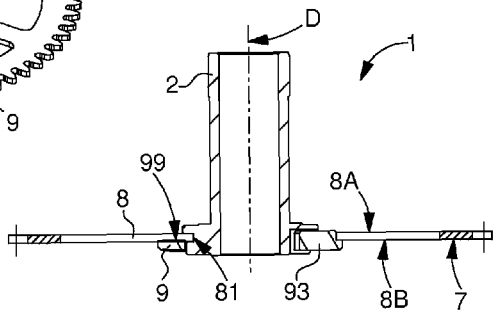
Figure 15:
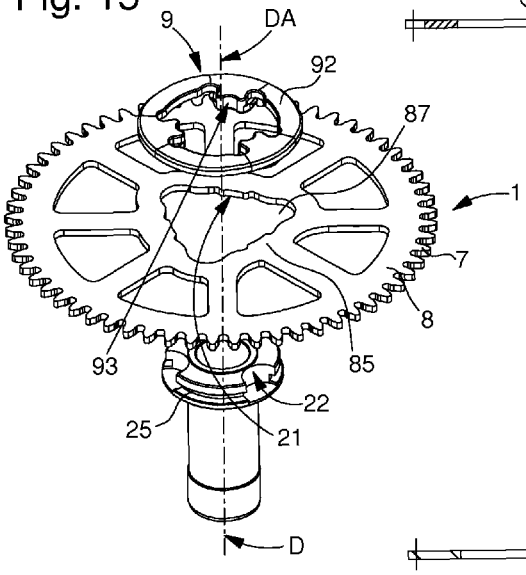
Figure 17:
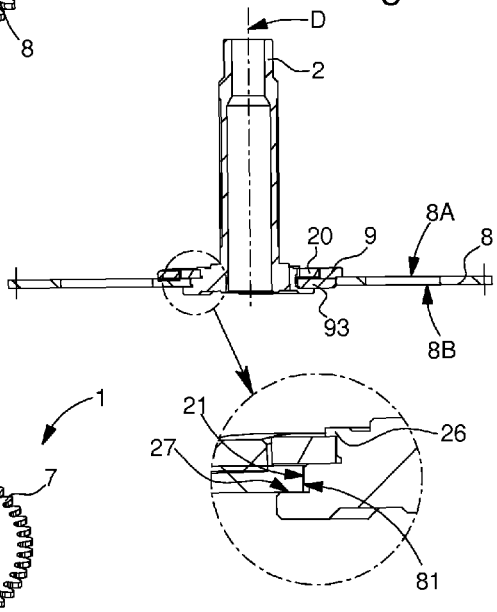
FIGS. 16 and 17 show, in a similar manner to FIGS. 1 and 2, a second embodiment of the invention wherein the wheel, illustrated here in the form of a minute wheel, includes a toothed flange centred on an arbour, said flange being pivotally connected to the arbour by a flexible element which can deform in the event of shock and is also elastomer or similar, said flexible element is pressed onto a top surface of the flange, and like the flange, is held on the arbour by a locking washer driven or riveted onto the arbour, the Figures illustrating a version with a rivet seam prepared on the blank arbour and shaped after the locking washer has been mounted.
Figure 16:
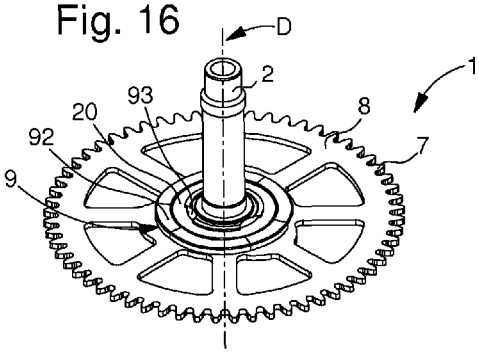

FIGS. 13 to 15 illustrate a similar assembly of an hour wheel, the assembly is carried out in the same manner but with arbour 2 turned the other way up.

In a particular variant of this first embodiment, on at least of the thickness thereof, each boss 93 is symmetrical relative to a plane passing through axial direction DA and includes at least two curved ridges 95 oriented towards axial direction DA, separated by a curved hollow 96 for absorbing the compression of boss 93 in the event of a shock. In the particular case of the Figures, boss 93 has a profile of this type, further delimited laterally by curved hollows 97, on only one side 9A of flexible element 9, and the main surface 91, called the top surface, visible in FIG. 1, is intended to move above a top surface 8A of flange 8, whereas, on the opposite side, part 9B of boss 93 is substantially cylindrical, and forms the active surface for shock absorption. Surface 99, called the bottom surface, of part 9B is intended to be substantially flush with the bottom surface 8B of flange 8. Part 9A thus permits cylindrical part 9B to be held in the correct position. Boss 93 allows some deformation, particularly twisting, of part 9A relative to part 9B, which absorbs part of the energy from the shock, the other part of the energy being absorbed by the compression of part 9B.

In the second embodiment of FIGS. 16 to 29, flexible element 9 is mounted confined between flange 8 and a locking washer 20 driven or crimped onto arbour 2.

Minute wheel 1 includes a toothed wheel 8 centred on an arbour 2, said flange 8 being pivotally connected to arbour 2 by a flexible element 9 that can deform in the event of a shock and is also an elastomer or similar, said flexible element 9 is pressed onto a top surface 8A of flange 8, and is held, together with flange 8 on arbour 2 by a locking washer 20, driven, or preferably riveted, or similarly mounted on the arbour. The Figures show a version with a rivet seam 26 prepared on the blank arbour 2, and which is shaped after the assembly of locking washer 20.

In a variant, locking washer 20 is elastic, but has greater rigidity than flexible element 9; rivet seam 26 may then be a machined element of arbour 2, forming a top stop member for locking washer 20 which is shaped on arbour 2 when it is lockably mounted on flexible element 9.

Arbour 2 includes, on both sides of a cylindrical shoulder 21 arranged to centre flange 8, on the one hand, a shoulder 27 for axially immobilising flange 8, and on the other hand, rivet seam 26 for immobilising flange 8 and locking washer 20 once the flange and washer have been placed in position.

Figure 23:
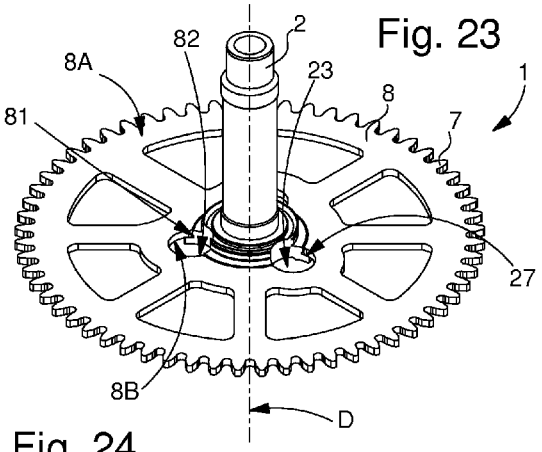
FIG. 23 shows a schematic perspective view of the flange being fitted onto the arbour in an end stop position, in an angular position corresponding to the matching of the receiving housings of the flange with complementary receiving housings of the arbour, to form together slots for the fitting in position of bosses comprised in the flexible element.

FIG. 23 shows flange 8 being fitted onto arbour 2 in an end stop position, in an angular position corresponding to the matching of receiving housings 82 of flange 8 with complementary receiving housings 22 of arbour 2, to form together slots 23 for the fitting in position of bosses 93 comprised in flexible element 9. Flexible element 9 preferably takes the form of a ring 92 on which three bosses forming bosses 93 are placed, which may be cylindrical or have a radial flat portion 90 for cooperating with arbour 2.

Figure 24:
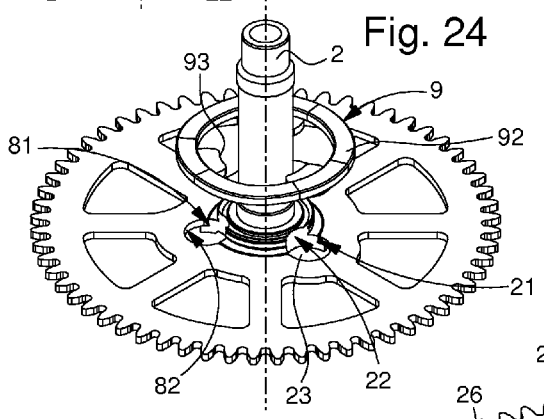
FIG. 24 shows a schematic, perspective view of the flexible element being placed in position, bearing on a top surface of the flange, and the cooperation of its bosses with the positioning slots.
Figure 25:
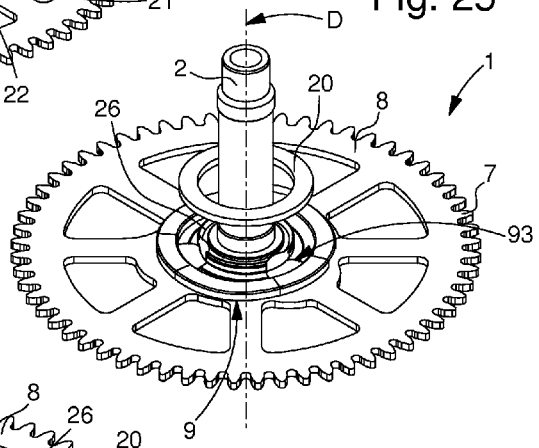
FIG. 25 shows the locking washer being fitted onto the flexible element by holding the washer on the flange.
Figure 26:
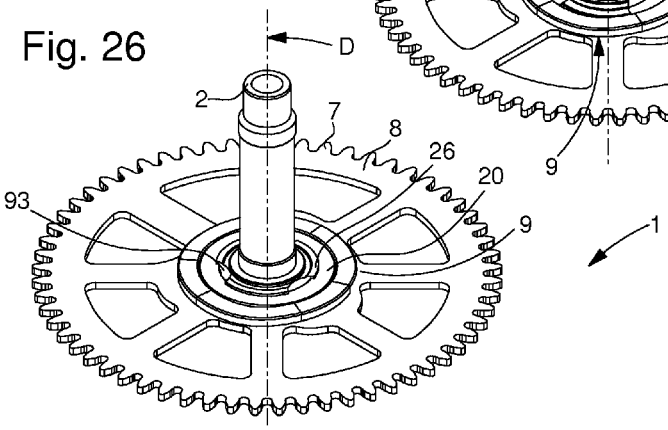
FIG. 26 showing the final position once the locking washer has been crimped onto the arbour.

FIG. 24 shows flexible element 9 being placed in position, in abutment on a top surface 8A of flange 8, and the cooperation of its bosses 93 with positioning slots 23; and FIG. 25 shows locking washer 20 being fitted onto flexible element 9 by compressing the washer on flange 8; FIG. 26 showing the final position once locking washer 20 has been crimped onto arbour 2 by upsetting the rivet seam 26.

Figure 27:
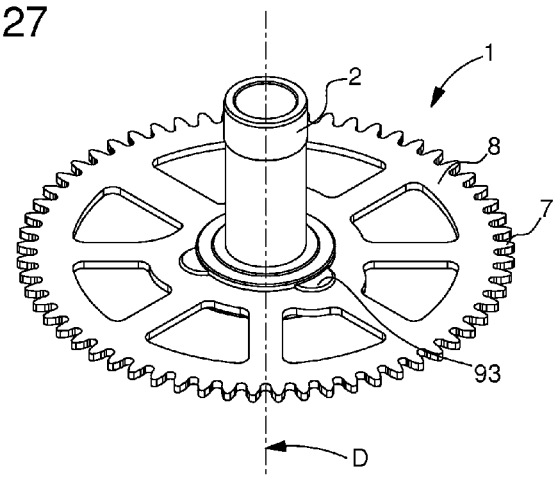
FIGS. 27 to 29 illustrate a similar assembly of an hour wheel, the assembly being carried out in the same manner but with arbour 2 turned the other way up.
Figure 28:
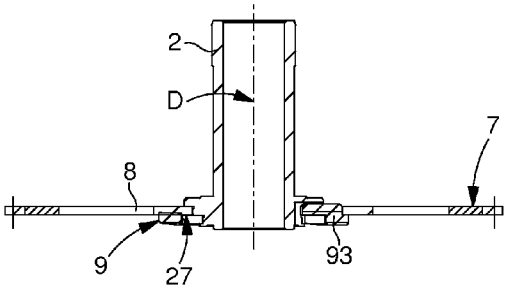
Figure 29:
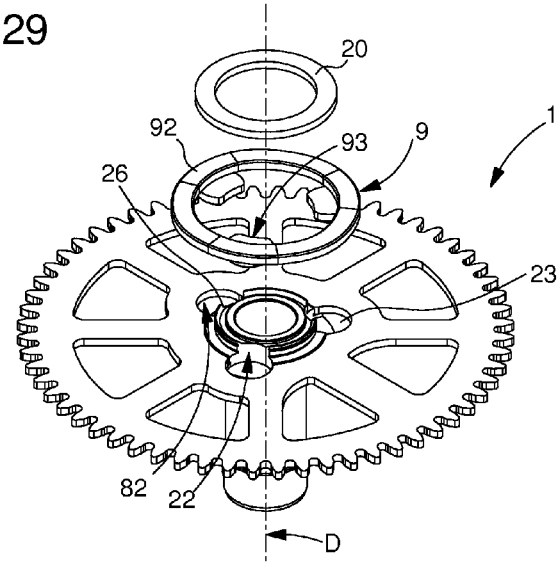
Figure 30:
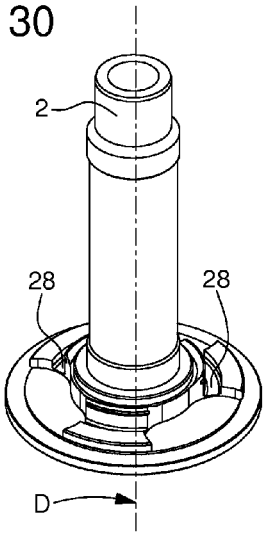
FIGS. 30 to 34 illustrate a third embodiment of the invention, wherein the wheel, illustrated here in the form of a minute wheel, includes a toothed flange centred on an arbour, said flange being pivotally connected to the arbour by a flexible element that can be deformed in the event of a shock, said flexible element is a substantially omega-shaped wire spring, held, on the one hand in a front groove of the arbour, and in the other hand in a chamber of the flange, in which it is held substantially coplanar to the flange.
Figure 31:
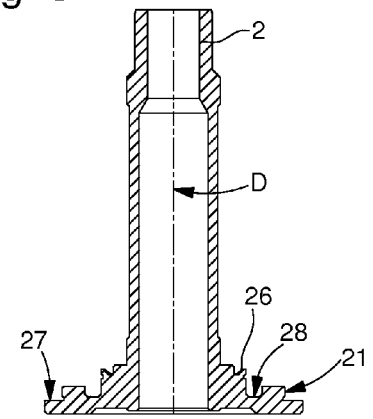
Figure 32:
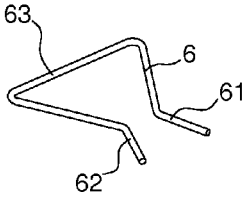
Figure 33:
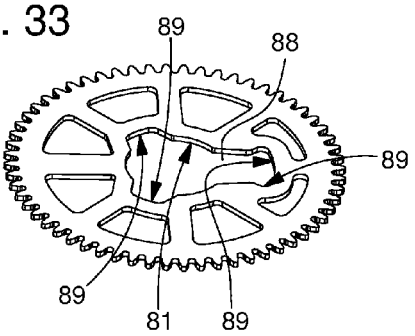
Figure 34:
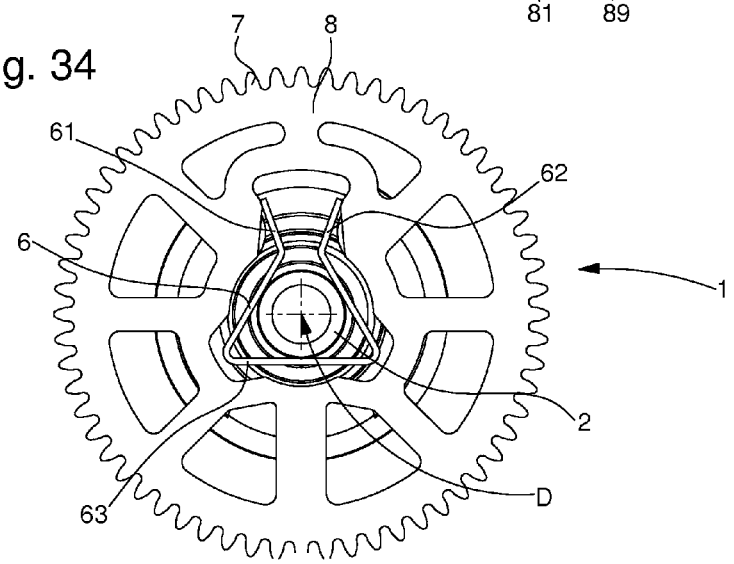
Figure 35:
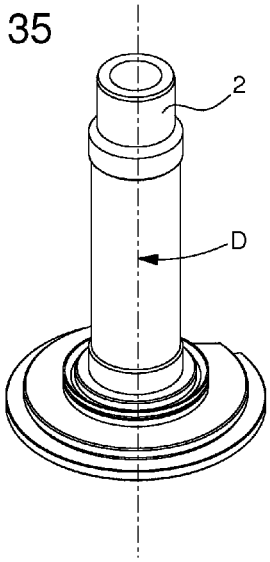
FIGS. 35 to 38 illustrate a fourth embodiment of the invention, with only two components, the arbour shown in perspective and in a top view in FIGS. 35 and 36, and the flange shown in perspective and a top view in FIGS. 37 and 38, said flange incorporating the flexible element in the form of two substantially radial and recessed strip springs in the thickness thereof, which cooperate in friction contact with a hollow, off-centre, cylindrical sector of the arbour.
Figure 36:
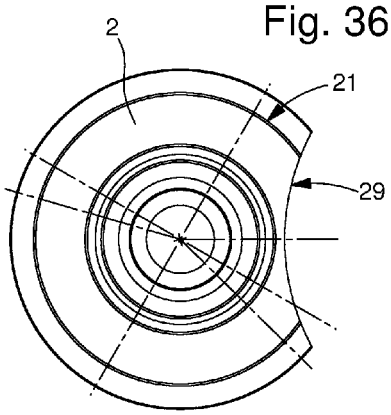
Figure 37:
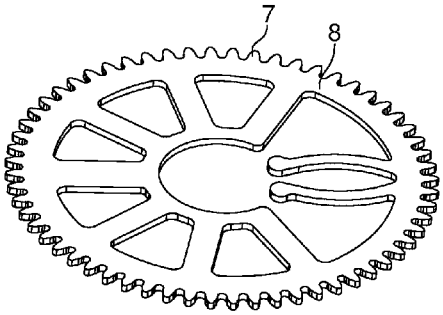
Figure 38:
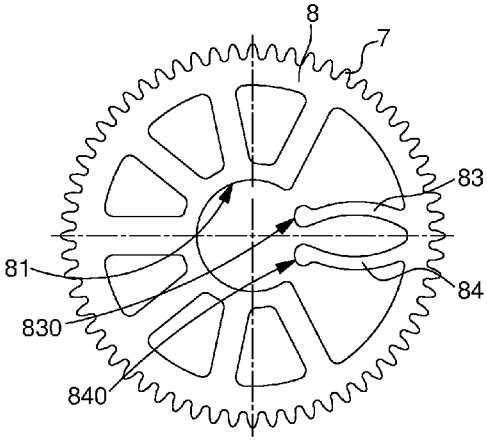

FIGS. 27 to 29 illustrate a similar assembly of an hour wheel, the assembly being carried out in the same manner but with arbour 2 turned the other way up.

Figure 41:
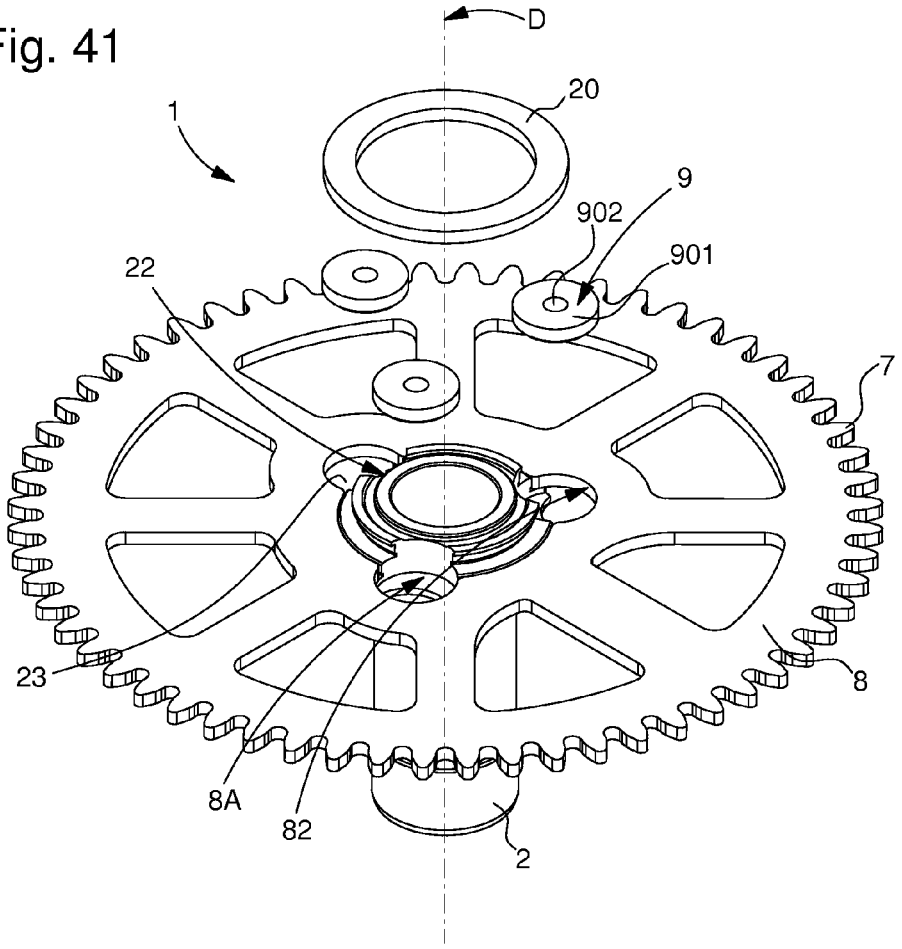
FIGS. 41 and 42 respectively show an exploded perspective view and a cross-section through a plane through the pivot axis, of another variant of the second embodiment, wherein the wheel flange carries housings cooperating with complementary housings of the arbour to form slots including a shouldered bearing surface, each slot receiving a circular flexible stud, pierced with a hole here, said studs together ensuring the same damping and geometry restoring function as the single flexible element of the preceding Figures.
Figure 42:
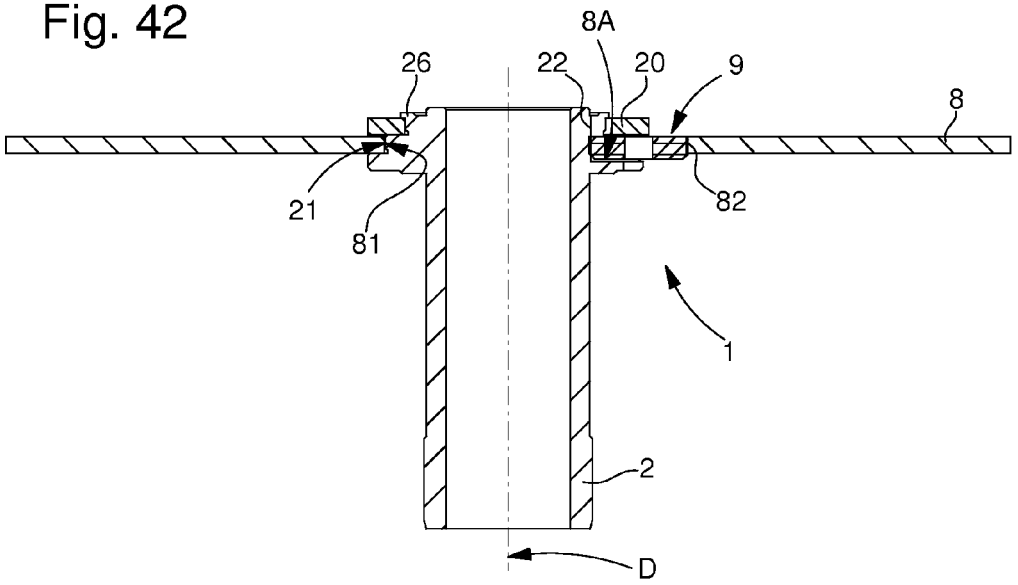

FIGS. 41 and 42 show another variant of the second embodiment, wherein flange 8 carries housings 82 cooperating with complementary housings 22 of arbour 2 to form slots 23 each having a shouldered bearing surface 8A. Each slot 23 receives a circular flexible stud 901. These studs 901, of which there are three here, are arranged at 120°, and together form flexible element 9, and together perform the same damping and geometry restoring function as the single flexible element 9 of the preceding variants. Stud 901 is advantageously pierced with a hole 902 which softens stud 901 if it is too rigid: as a result of hole 902, the deformation of stud 901—then annular—in the event of a shock, occurs by bending with regard to the edge of the ring. This therefore prevents any excessive deformation of stud 901, any buckling, and any risk of the gasket system jamming, or even any risk of stud 901 leaving its housing.

Preferably, locking washer 20 does not compress flexible element 9 axially on flange 8, to prevent an increase in friction and the apparent stiffness of flexible element 9. Washer 20 essentially has the function of a casing ring, and controls any axial play remaining in flange 8 for the unrestricted rotation thereof, and confines studs 901 with adjusted axial play to attenuate any friction.

Figure 18:
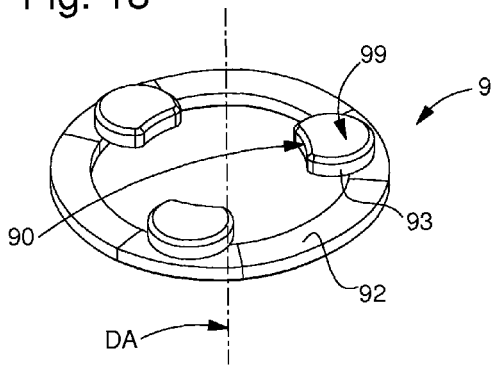
FIG. 18 shows a schematic, perspective view of the flexible element of FIG. 16.
Figure 21:
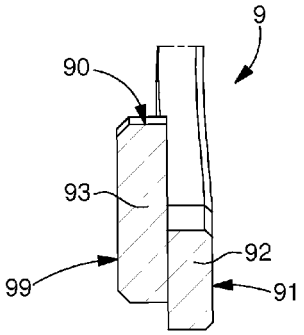
FIG. 21 a partial view along the cross-section AA of FIG. 19.
Figure 19:
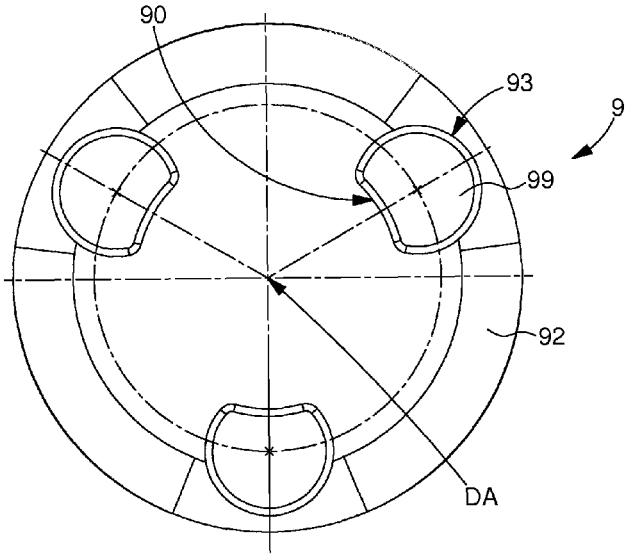
FIG. 19 shows a schematic, top, plan view of the same flexible element.
Figure 20:
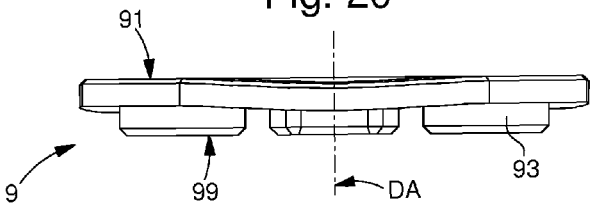
FIG. 20 shows a side view.
Figure 22:
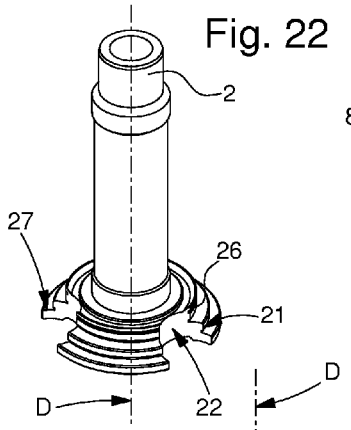
FIG. 22 shows a schematic perspective view of the arbour of FIG. 16 including, on either side of a cylindrical shoulder arranged to centre the flange, on the one hand a shoulder for axially immobilising the flange, and on the other hand a rivet seam for immobilising the flange and the locking washer once placed in position.
Figure 43:
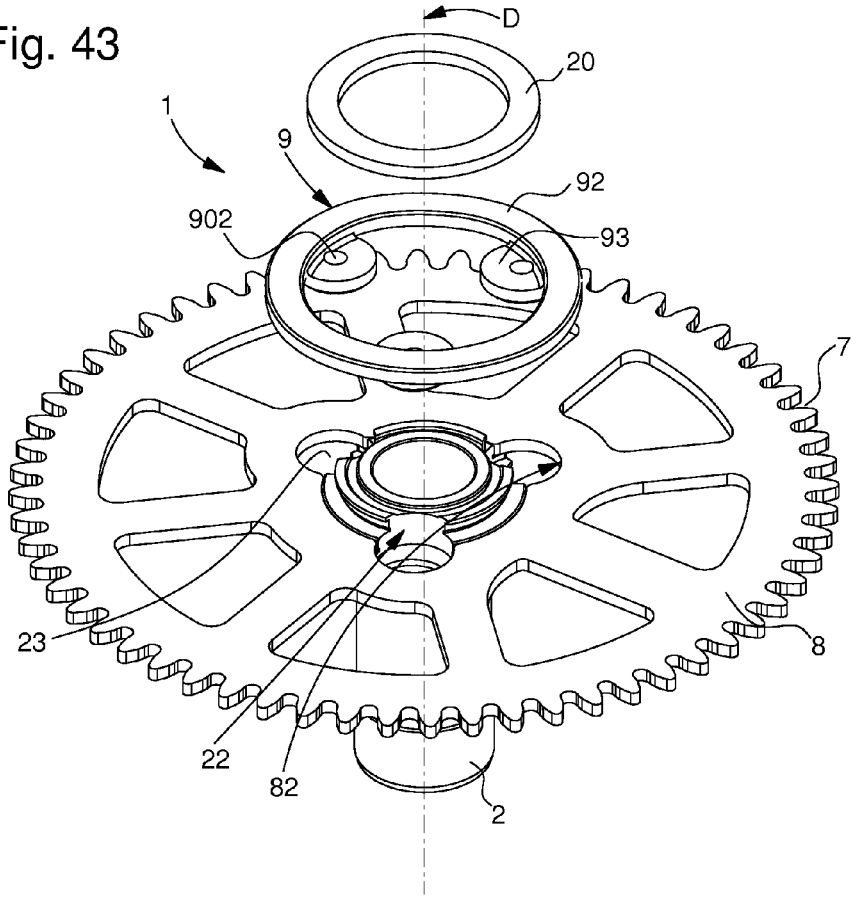
FIGS. 43 and 44 respectively show in an exploded perspective view and a cross-section through a plane through the pivot axis, another variant of the second embodiment, wherein a single flexible element similar to that of FIG. 18 carries similar bosses to the circular pierced studs of FIGS. 41 and 42, said studs being on an offset level relative to the plane of the carrier ring.
Figure 44:
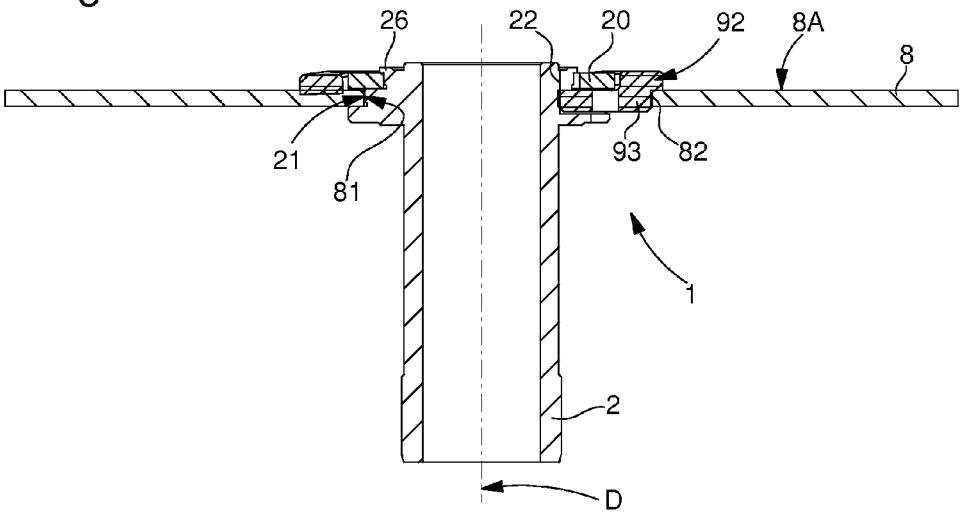

FIGS. 43 and 44 show another variant of the second embodiment, wherein a single flexible element 9 similar to that of FIG. 18 carries circular bosses 93 similar to the circular pierced studs 901 of FIGS. 41 and 42, said circular studs 93 being on an offset level with respect to the plane of the carrier ring.

Figure 45:
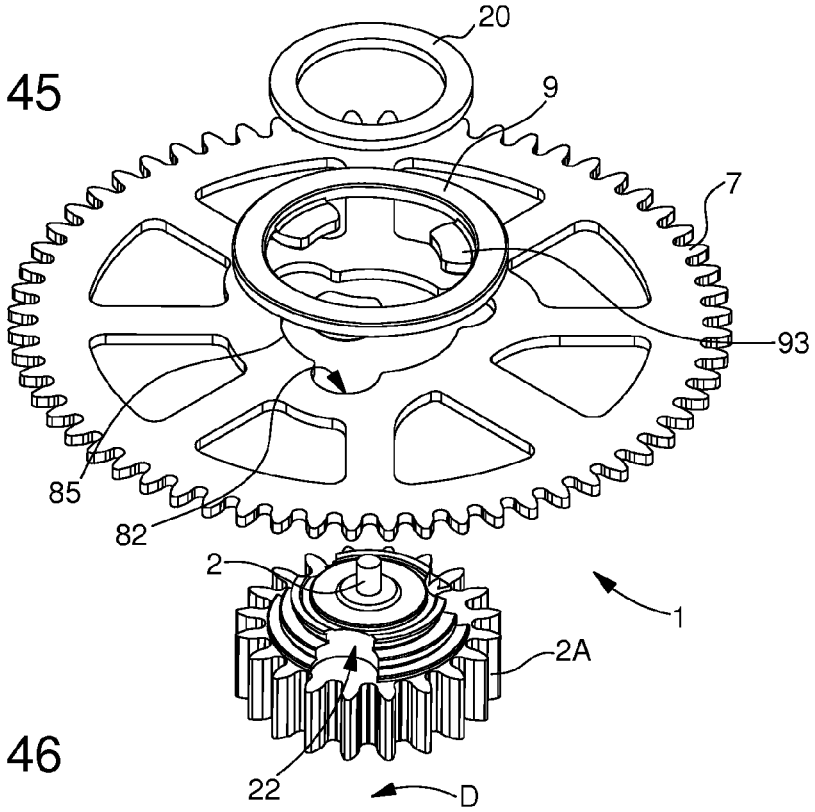
FIGS. 45, 46 and 47 respectively show in an exploded perspective view, assembled perspective view, and cross-section through a plane through the pivot axis, another variant of the second embodiment, similar to those of FIGS. 16 to 26, and wherein the arbour carries a pinion coaxial to the wheel.
Figure 46:
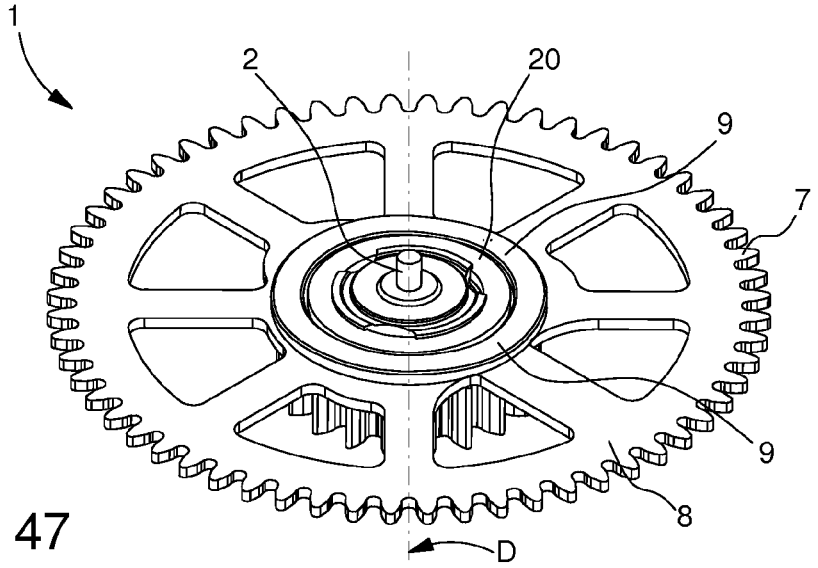
Figure 47:
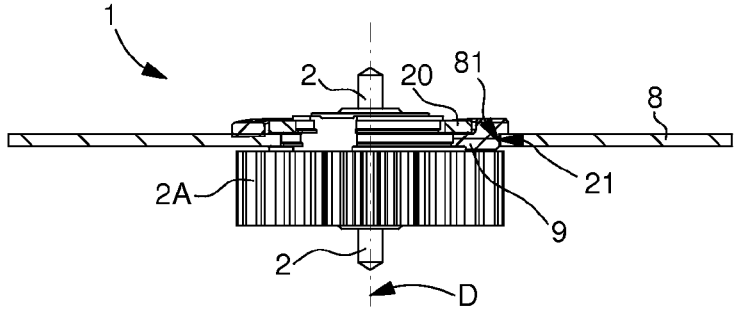

FIGS. 45, 46 and 47 show another variant of the second embodiment, similar to that of FIGS. 16 to 21, and wherein arbour 2 carries a pinion 2A coaxial to wheel drive means 7, pivotal guiding being achieved via the end trunnions.

In the third embodiment of FIGS. 30 to 34, flexible element 9 is a substantially omega-shaped wire spring 6, held on the one hand in a front groove 28 of arbour 2, and on the other hand in a chamber 88 of flange 8, in which spring 6 is held substantially coplanar to flange 8. Shaped spring 6 is placed between flange 8 and arbour 2. Spring 6 cannot pivot on arbour 2. Branches 61 and 62 of the spring are pre-loaded on flange 8. A washer in abutment on and riveted to arbour 2 forms an axial stop member for flange 8 and confines and guides spring 6 in the plane of flange 8. In the event of a shock, branches 61 and 62 of spring 6 are deformed and thus absorb part of the energy from the shock. When the shock has finished, flange 8 returns to its initial position relative to arbour 2.

In the fourth embodiment of FIGS. 35 to 38, flexible element 9 is integrated in flange 8 and includes two substantially radial and recessed strip springs 83, 84 in the thickness thereof, which cooperate in abutment by friction with a hollow, off-centre, cylindrical sector 29 of arbour 2.

In another embodiment (not illustrated), flexible element 9 is formed by an elastomer overmould holding flange 8 and arbour 2 together. The overmould concerns an elastomer with a hardness of between 20 and 70 Shore A.

The invention further concerns a timepiece movement 100 including a shockproof wheel 1 of this type carrying one component 4 of this type having unbalance relative to a pivot axis D of wheel 1. Component 4 may in a non-limiting manner be:

a hand 5
an oscillating winding weight
a strike hammer
a lever.

Figure 39:
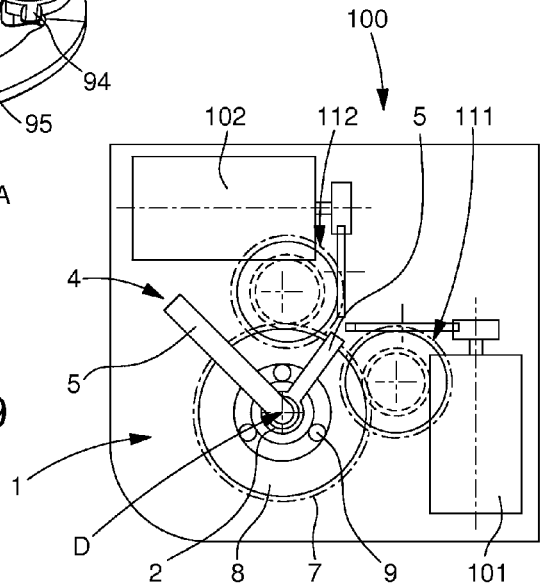
FIG. 39 illustrates, in a top view, a movement with separate electrical drive systems for the minute and hour wheels, connected by gear trains to wheels of the invention, only one of which is shown in the Figure.

In particular, as seen in FIG. 39, timepiece movement 100 includes at least one electric motor 101 for driving at least one hand 5, and includes at least one shockproof wheel 1, either carrying a hand 5, or inserted in a gear train 111 between hand 5 and motor 101.

The invention also concerns a watch 200 including at least one timepiece movement 100 of this type.

The invention claimed is:

1. A shockproof timepiece wheel for driving a component having unbalance relative to a pivot axis of said wheel, said wheel includes, on the one hand, an arbour for pivotally guiding the wheel about said pivot axis, and on the other hand, a drive means arranged or assembled on a flange of said wheel, said wheel including at least one flexible element between said arbour and said flange, wherein said flange includes a cylindrical shoulder cooperating in abutment for centring purposes with a complementary cylindrical shoulder comprised in said arbour to ensure the perfect concentricity of said drive means with said arbour, and wherein said flexible element is either confined between said flange and a locking washer held on said arbour or snapped onto said flange and/or said arbour, and wherein said flexible element includes bosses arranged, in normal operation, to transmit a drive torque between said arbour and said flange, and, in the event of any shock, to absorb the torsion between said arbour and said flange, to dissipate part of the energy from said shock by friction to modify the effect on said drive means of the amplitude and the duration of said shock by reducing the amplitude and increasing the duration thereof, and to form an elastic return means returning said flange to a position of realignment relative to said arbour after said shock.

2. The wheel according to claim 1, wherein said flexible element is an interchangeable element distinct from said arbour and from said flange and whose resilience is selected according to the maximum allowable value of said unbalance.

3. The wheel according to claim 1, wherein said flexible element is confined between said flange and a locking washer driven or crimped onto said arbour.

4. The wheel according to claim 1, wherein said flexible element is snapped on both sides of an area of assembly of said cylindrical shoulder to said complementary cylindrical shoulder.

5. The wheel according to claim 1, wherein said flexible element is snapped on an assembly area of said cylindrical shoulder and of said complementary cylindrical shoulder.

6. The wheel according to claim 1, wherein said flexible element includes snap-on lugs for holding said flexible element snapped on said cylindrical shoulder and/or said complementary cylindrical shoulder.

7. The wheel according to claim 1, wherein said bosses are connected by a ring of said flexible element, said ring being arranged to move into abutment on a lateral surface of said flange.

8. The wheel according to claim 7, wherein said ring is located in a plane distinct from a plane in which said bosses extend, and wherein said flange includes a housing for receiving said arbour, in that said arbour includes a groove arranged to receive, in a first relative angular position, a rib comprised in said flange, when said arbour and said flange are assembled to said cylindrical shoulder in abutment for centring purposes with said complementary cylindrical shoulder, and when said flange is in an abutment position, abutting via a lateral surface of said flange against a shoulder surface of said arbour, said groove allowing said arbour to pivot in the manner of a bayonet relative to said flange in at least one second relative angular position in which said housings and said complementary housings are aligned and, in pairs, form slots for receiving said bosses in a comprehensive and complementary manner when said flexible element is pressed onto said flange, said bosses then angularly indexing said flange relative to said arbour.

9. The wheel according to claim 1, wherein said ring is located in a plane distinct from a plane in which said bosses extend.

10. The wheel according to claim 1, wherein there is only one said flexible element and said element carries bosses on an offset level with respect to the plane of a carrier ring.

11. The wheel according to claim 1, wherein said bosses are identical to each other and arranged regularly around an axial direction about which said flexible element extends.

12. The wheel according to claim 11, wherein each said boss is symmetrical relative to a plane passing through said axial direction and includes at least two curved ridges oriented towards said axial direction.

13. The wheel according to claim 1, wherein said flange includes housings for receiving and centring said bosses comprised in said flexible element.

14. The wheel according to claim 13, wherein said arbour includes complementary housings for receiving and centring said bosses comprised in said flexible element, and wherein said arbour and said flange are arranged so that, in at least one angular position of one relative to the other when said arbour and said flange are assembled to said cylindrical shoulder, cooperating in abutment for centring purposes with said complementary cylindrical shoulder, said housings and said complementary housings, in pairs, form slots for receiving said bosses in a comprehensive and complementary manner when said flexible element is pressed onto said flange.

15. The wheel according to claim 1, wherein said arbour includes complementary housings for receiving and centring said bosses comprised in said flexible element.

16. The wheel according to claim 1, wherein said arbour includes a pinion coaxial to said drive means.

17. A timepiece movement including a wheel according to claim 1 carrying a component having unbalance relative to a pivot axis of said wheel, wherein said component is a hand.

18. A timepiece including at least one timepiece movement according to claim 17.

19. A timepiece movement including a wheel according to claim 1 carrying a component having unbalance relative to a pivot axis of said wheel, wherein said component is an oscillating winding weight.

20. A timepiece movement including a wheel according to claim 1 carrying a component having unbalance relative to a pivot axis of said wheel, wherein said component is a strike hammer.

21. A timepiece movement including a wheel according to claim 1 carrying a component having unbalance relative to a pivot axis of said wheel, wherein said component is a lever.

22. A timepiece movement including at least one electric motor for driving at least one wheel according to claim 1, said wheel carrying one hand.

23. A timepiece movement including at least one electric motor for driving at least one wheel according to claim 1, said wheel inserted in a gear train between one hand and said motor.

24. A timepiece including at least one timepiece movement according to claim 23.

25. A shockproof timepiece wheel for driving a component having unbalance relative to a pivot axis of said wheel, said wheel includes, on the one hand, an arbour for pivotally guiding the wheel about said pivot axis, and on the other hand, a drive means arranged or assembled on a flange of said wheel, said wheel including at least one flexible element between said arbour and said flange, wherein said flange includes a cylindrical shoulder cooperating in abutment for centring purposes with a complementary cylindrical shoulder comprised in said arbour to ensure the perfect concentricity of said drive means with said arbour, and wherein said flexible element is a substantially omega-shaped wire spring, held on the one hand in a front groove of said arbour, and on the other hand in a chamber of said flange, in which said spring is held substantially coplanar to said flange.

26. A shockproof timepiece wheel for driving a component having unbalance relative to a pivot axis of said wheel, said wheel includes, on the one hand, an arbour for pivotally guiding the wheel about said pivot axis, and on the other hand, a drive means arranged or assembled on a flange of said wheel, said wheel including at least one flexible element between said arbour and said flange, wherein said flange includes a cylindrical shoulder cooperating in abutment for centring purposes with a complementary cylindrical shoulder comprised in said arbour to ensure the perfect concentricity of said drive means with said arbour, and wherein said flexible element is integrated in said flange and includes two substantially radial and recessed strip springs in the thickness thereof, which cooperate in abutment by friction with an off-centre hollow cylindrical sector of said arbour.

27. A shockproof timepiece wheel for driving a component having unbalance relative to a pivot axis of said wheel, said wheel includes, on the one hand, an arbour for pivotally guiding the wheel about said pivot axis, and on the other hand, a drive means arranged or assembled on a flange of said wheel, said wheel including at least one flexible element between said arbour and said flange, wherein said flange includes a cylindrical shoulder cooperating in abutment for centring purposes with a complementary cylindrical shoulder comprised in said arbour to ensure the perfect concentricity of said drive means with said arbour, and wherein said flexible element is formed by an elastomer overmould holding said flange and said arbour together.

* * * * *